US008657469B2

(12) United States Patent
Liao et al.

(10) Patent No.: US 8,657,469 B2
(45) Date of Patent: Feb. 25, 2014

(54) TRAFFIC LIGHT ASSEMBLY

(71) Applicant: Advanced Optoelectronic Technology, Inc., Hsinchi Hsien (TW)

(72) Inventors: Chi-Wei Liao, Hsinchu (TW); Wen-Liang Tseng, Hsinchu (TW); Min-Tsun Hsieh, Hsinchu (TW); Chih-Yung Lin, Hsinchu (TW); Ching-Lien Yeh, Hsinchu (TW)

(73) Assignee: Advanced Optoelectronic Technology, Inc., Hsinchu Hsien (TW)

( * ) Notice: Subject to any disclaimer, the term of this patent is extended or adjusted under 35 U.S.C. 154(b) by 0 days.

(21) Appl. No.: 13/891,139

(22) Filed: May 9, 2013

(65) Prior Publication Data

US 2013/0242554 A1 Sep. 19, 2013

Related U.S. Application Data

(62) Division of application No. 12/900,502, filed on Oct. 8, 2010, now Pat. No. 8,459,838.

(30) Foreign Application Priority Data

Apr. 22, 2010 (CN) ..... 2010 1 01514894

(51) Int. Cl.
*F21V 33/00* (2006.01)

(52) U.S. Cl.
USPC ..... 362/253; 362/246; 362/375; 362/234

(58) Field of Classification Search
USPC ..... 362/234, 253, 311.01, 248, 457, 317, 362/352, 450, 321, 375
See application file for complete search history.

(56) References Cited

U.S. PATENT DOCUMENTS

| | | | | |
|---|---|---|---|---|
| 4,460,935 | A * | 7/1984 | Uehira | 361/91.5 |
| 5,517,395 | A * | 5/1996 | Weissman | 362/363 |
| 6,332,696 | B2 * | 12/2001 | Schepens | 362/311.03 |

FOREIGN PATENT DOCUMENTS

| | | | |
|---|---|---|---|
| CN | 2349479 | Y | 11/1999 |
| CN | 201276092 | Y | 7/2009 |
| CN | 201342413 | Y | 11/2009 |
| JP | 3938482 | B2 | 6/2007 |

* cited by examiner

*Primary Examiner* — Bao Q Truong
(74) *Attorney, Agent, or Firm* — Altis Law Group, Inc.

(57) ABSTRACT

A traffic light assembly includes at least one light module, at least one lens located in front of the at least one light module, a housing enclosing the at lest one light module and the at least one lens therein, and a foldable cover located in front of the at least one lens and connected to the housing. A cleaning device is located on an outer surface of the foldable cover to clean snow and dust accumulated on the outer surface of the foldable cover.

4 Claims, 6 Drawing Sheets

TRAFFIC LIGHT ASSEMBLY

CROSS-REFERENCE TO RELATED APPLICATIONS

This patent application is a divisional application of patent application Ser. No. 12/900,502, filed on Oct. 8, 2010 and entitled "TRAFFIC LIGHT," which is assigned to the same assignee as the present application, and which is based on and claims priority from Chinese Patent Application No. 201010151489.4 filed in China on Apr. 22, 2010. The disclosures of patent application Ser. No. 12/900,502 and the Chinese Patent Application are incorporated herein by reference in their entireties.

BACKGROUND

1. Technical Field

The present disclosure relates to a lamp assembly, and particularly, to a traffic light assembly.

2. Description of Related Art

An outdoor lamp is easily affected by the changes in the weather, particularly during a sandstorm or when it is snowing. For example, snow usually accumulates on the traffic light assembly, and eventuality becomes ice. The snow or sand accumulating on the light-emitting surface of the traffic light assembly blurs the traffic light, and makes the light unclear and hard to view. Because there are usually numerous traffic lights on the streets, and each traffic light is set to a certain height, it is difficult to clean the traffic light assembly manually.

It is thus desirable to provide a traffic light assembly which can overcome the described limitations.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail with reference to the accompanying drawings.

Figure 1:
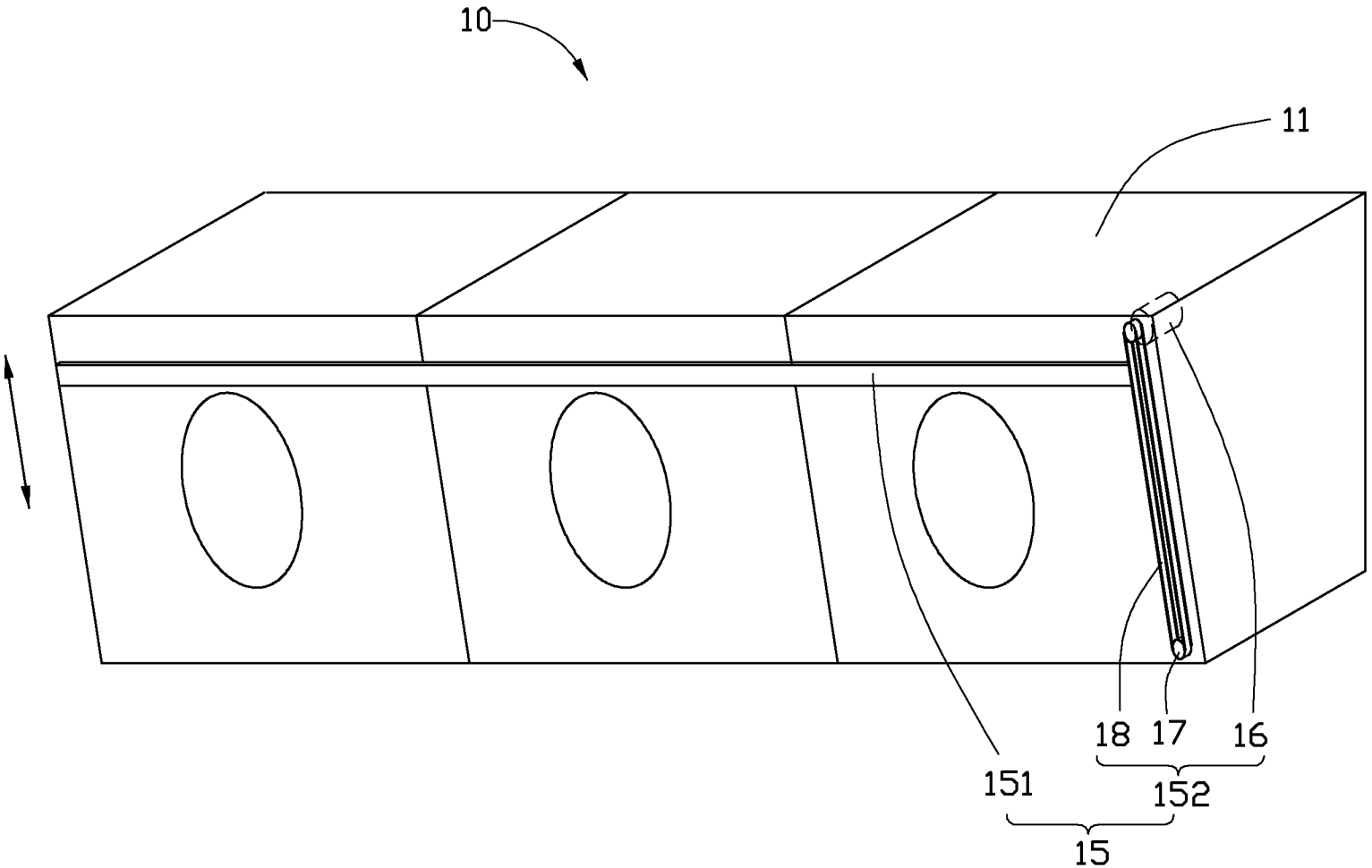
FIG. 1 is an isometric view of the traffic light assembly according to the first embodiment of the present disclosure.
Figure 2:
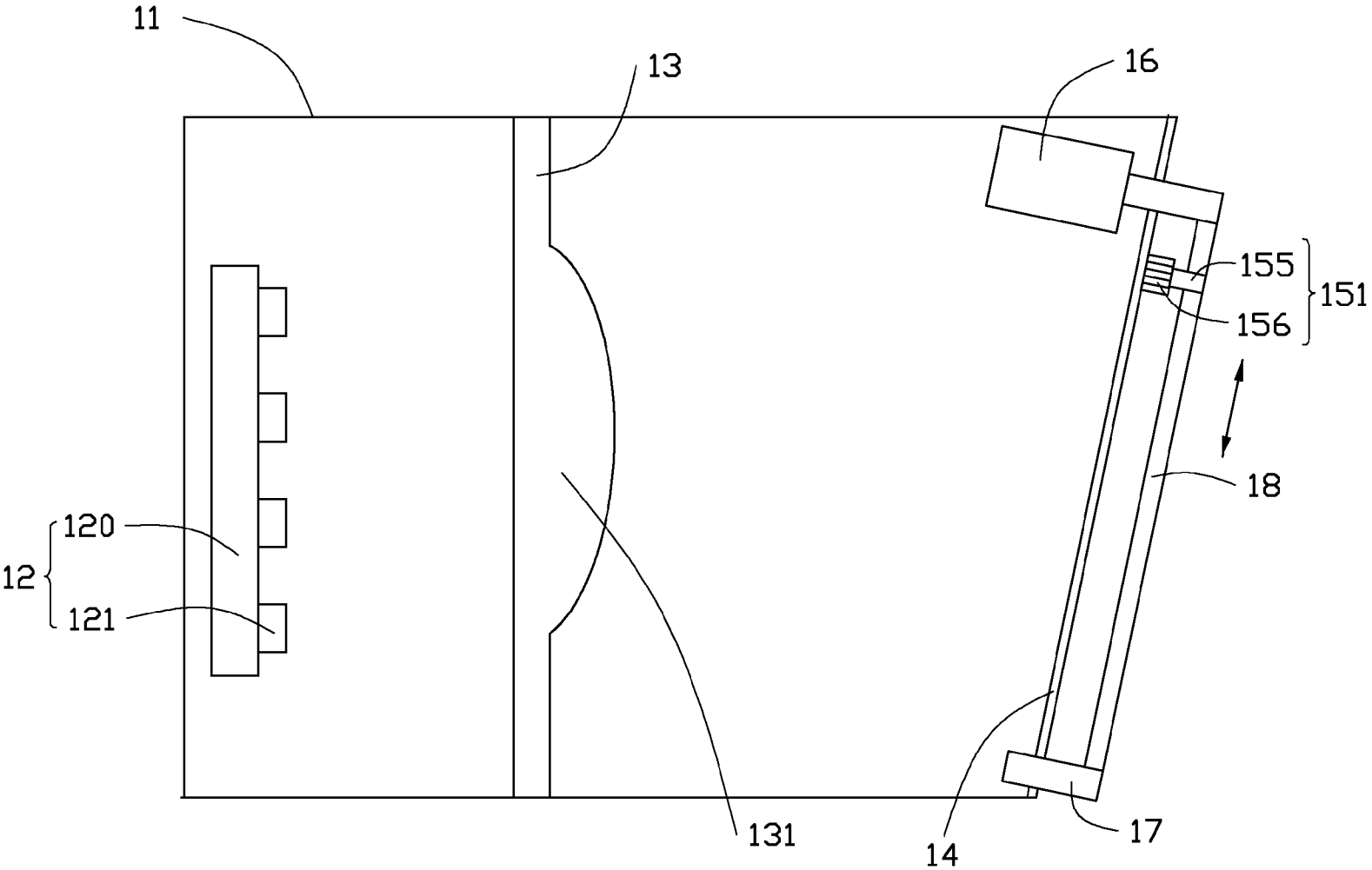
FIG. 2 is a cross-sectional view of the traffic light assembly of FIG. 1.

Refer to FIG. 1 and FIG. 2 which illustrate the traffic light assembly 10 according to the first embodiment of the present disclosure. The traffic light assembly 10 includes a housing

11, a number of light modules 12, a number of lenses 131 corresponding to the light modules 12, a transparent cover 14 located in front of the lenses 131, and a cleaning device 15 located on the front of the transparent cover 14.

The housing 11 is a box having an opening (not labeled) located in front of the corresponding light modules 12. Light of the light modules 12 can pass outward through the lenses 131 and the opening. The top wall of the housing 11 extends further than the bottom wall to decrease interference of snow and sand with the light-emitting path of the light modules 12. Accordingly, the light-emitting opening tilts inward from top to bottom.

The light modules 12 are surrounded by the housing 11. In this embodiment, the traffic light assembly 10 may include three light modules 12 in the housing 11, and the light modules 12 may be light-emitting diode (LED) modules. Each light module 12 includes a substrate 120 and a number of LEDs 121 positioned on the substrate 120. The LEDs 121 oppose the light-emitting opening of the housing 11.

The lenses 131 may be made out of transparent materials, such as glass or plastic. The lenses 131 can change the illumination distribution, and increase clarity of the traffic signal. For example, in this embodiment, the lenses 131 are convex lenses. The traffic light assembly 10 may include three lenses 131 corresponding to the three light modules 12 in the housing 11, and the lenses 131 are integrally combined by a plate 13.

The transparent cover 14 is a plate made out of transparent materials, such as glass or plastic. The transparent cover 14 is located in the light-emitting opening of the housing 11, and tilts inward from top to bottom. The transparent cover 14 prevents snow, sand and moisture from entering the traffic light assembly 10. Thus, the life time of the light modules 12 can be elongated.

The cleaning device 15 includes a wiper 151 and a driver 152. The wiper 151 may be made out of plastic and rubber, but is not limited thereto. The wiper 151 is a bar crossing on an even plane to the transparent cover 14.

The wiper 151 may include a body 155 connected to the driver 152, and a bristle portion 156 extending from the inner surface of the body 155 toward the transparent cover 14. The bristle portion 156 may look like wool, and contacts the outer surface of the transparent cover 14. Thus, the motion of the wiper 151 can sweep the snow and dust away from the transparent cover 14. In other embodiments, the bristle portion 156 may be omitted. In such a case, the body 155 is a scraper directly contacting the outer surface of the transparent cover 14. A rubber scraper may replace the bristle portion 156. The wiper 151 can be transparent to improve the clarity of the signals of the traffic light assembly 10.

The driver 152 includes an actuator 16, a roller 17 and a connecting belt 18 connecting the actuator 16 and the roller 17. Both the actuator 16 and the roller 17 are located at the transparent cover 14 and may be adjacent to a side wall of the housing 11. The actuator 16 and the roller 17 are respectively located adjacent to the top and the bottom of the traffic light assembly 10 or the bottom and the top. The connecting belt 18 is vertically arranged, and parallel with the side wall of the housing 11. One terminal of the wiper 15 is fixed to the connecting belt 18, and the other is slidably attached to the opposite side wall of the housing 11.

Snowflakes may be blown toward the traffic light assembly 10 on a snowy day, and attach to the transparent cover 14. The cleaning device 15 and the driver 152 accept external control signals from an infrared remote sensor, and the actuator 16 of the driver 152 may rotate clockwise or anti-clockwise. The connecting belt 18 is driven by the driver 152, and the wiper 151 is driven by connecting belt 18 to move up and down. The wiper 151 can sweep the snow and dust away from the transparent cover 14.

Figure 3:
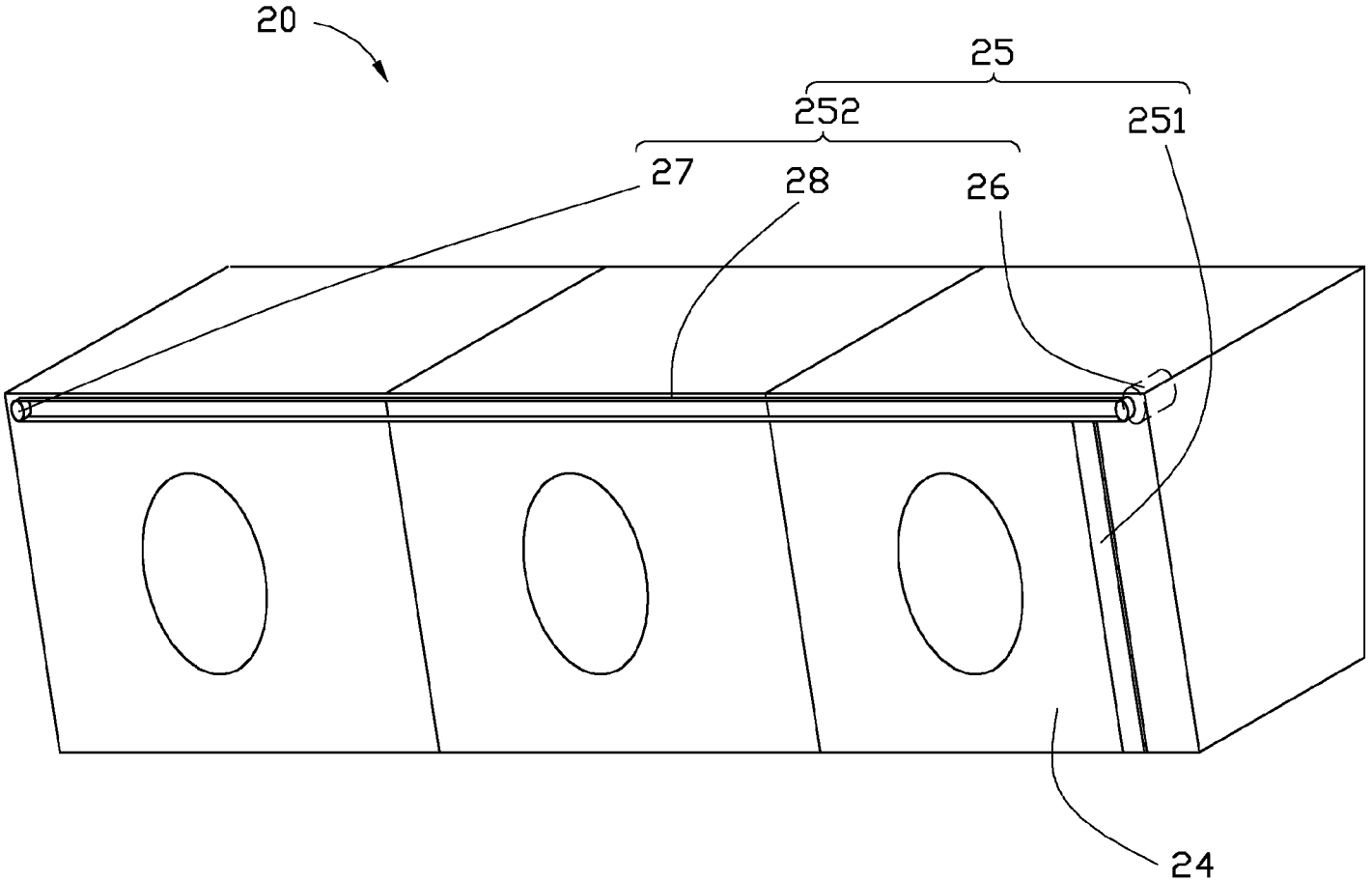
FIG. 3 is an isometric view of the traffic light assembly according to the second embodiment of the present disclosure.

Referring to FIG. 3, it illustrates the traffic light assembly 20 according to the second embodiment of the present disclosure. The main difference between the first and second embodiments is the arrangement and motion of the cleaning device. The cleaning device 25 in the traffic light assembly 20 includes a wiper 251 vertically crossing the transparent cover 24, and a driver 252 crossing on an even plane of the transparent cover 24. The actuator 26 and the roller 27 are located adjacent to the left and right of the traffic light assembly 20 respectively near the top of the traffic light assembly 20. Accordingly, the connecting belt 28 is arranged on an even plane, and the actuator 26 drives the wiper 251 to move left and right.

Figure 4:
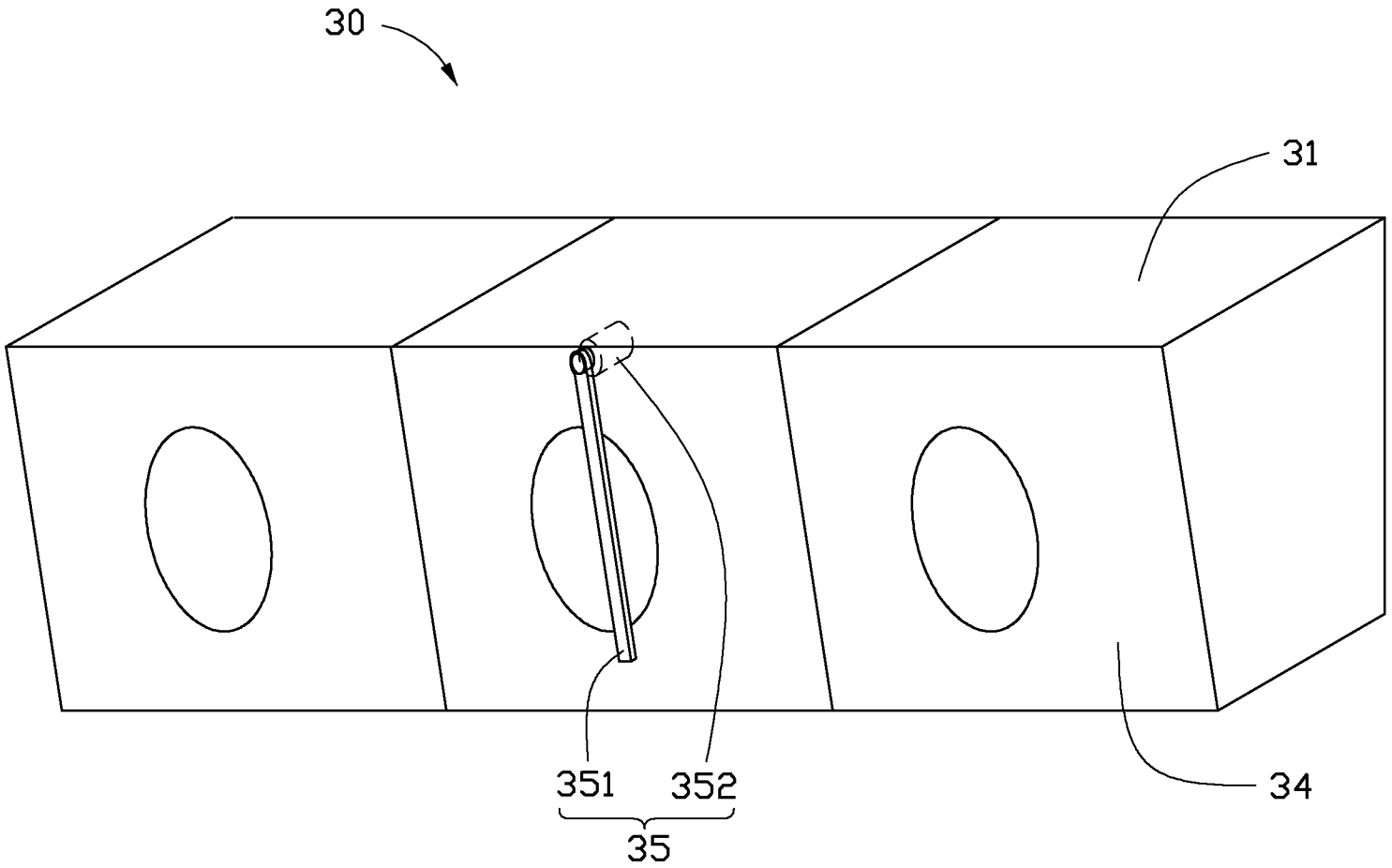
FIG. 4 is an isometric view of the traffic light assembly according to the third embodiment of the present disclosure.

Referring to FIG. 4, it illustrates the traffic light assembly 30 according to the third embodiment of the present disclosure. The main difference between the first and third embodiments also lies in the arrangement and motion of the cleaning device. The driver 352 of the cleaning device 35 is an actuator, and the wiper 351 is rotatably fixed to the driver 352. The driver 352 may be fixed on the transparent cover 34 near the top surface of the housing 31. Accordingly, the wiper 351 sweeps in an arc over a specific region for cleaning. The numbers and size of the cleaning device 35 can be adjusted according to the number of the light modules. For example, the traffic light assembly 30 may include three cleaning devices 35 corresponding to the three light modules.

The transparent covers 14, 24, and 34 in the first, second and third embodiments may be omitted, and the cleaning devices 15, 25, and 35 may directly sweep the lenses of the traffic light assemblies 10, 20 and 30. The seams between the lenses and the housing can be filled with a transparent waterproof silicone to protect the light module from the surroundings.

Figure 5:
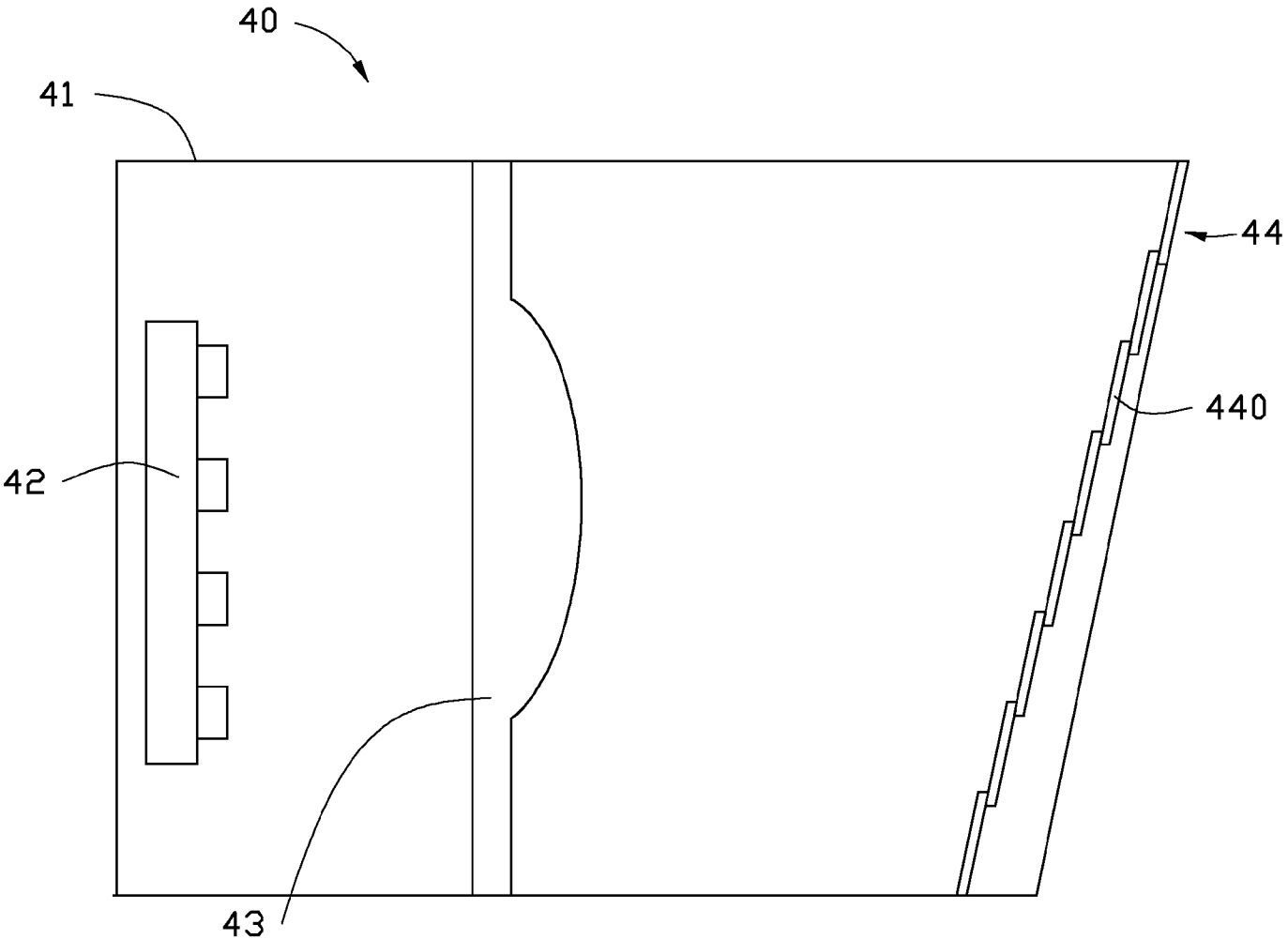
FIG. 5 is a cross-sectional view of the traffic light assembly according to the fourth embodiment of the present disclosure, in which a foldable cover of the traffic light assembly is in the unfolded state.
Figure 6:
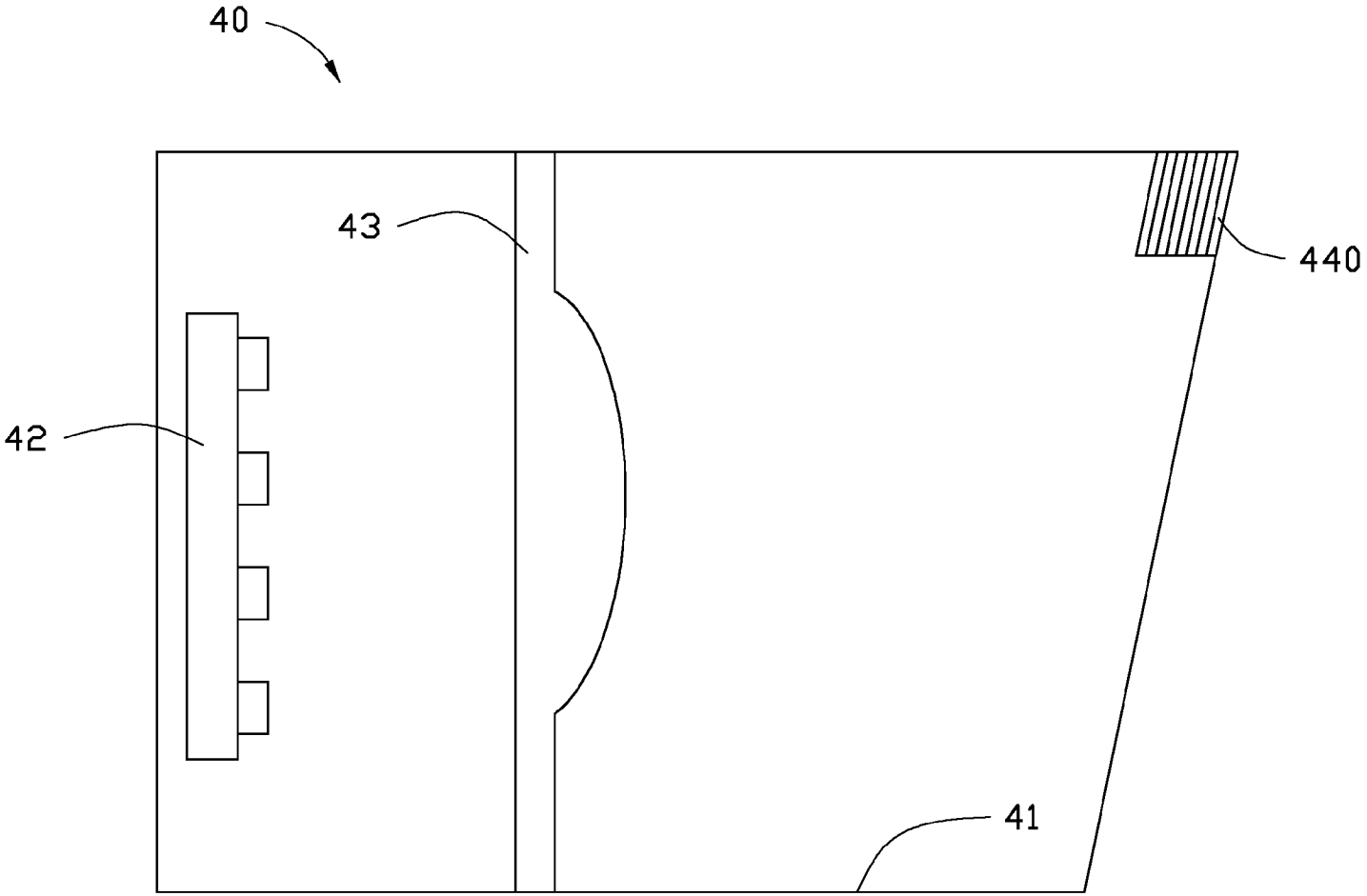
FIG. 6 is a view similar to FIG. 5, but shows the foldable cover in the folded state.

Refer to FIG. 5 and FIG. 6 illustrating the traffic light assembly 40 according to the fourth embodiment of the present disclosure. The main difference between the first and fourth embodiments also lies in the structure of the transparent cover. The traffic light assembly 40 includes a housing 41, at least one light module 42, at least one lens 43, and a foldable cover 44. The foldable cover 44 includes a number of covering slats 440. Each covering flake 440 is slidably attached to the adjacent upper flake 440 and lower flake 440.

The foldable cover 44 may be transparent, but is not limited thereto. When the corresponding light module 42 is turned off on a snowy day, the foldable cover 44 can unfold to prevent the snow from accumulating in the traffic lamp assembly 40 via the front opening of the housing 41. In the unfolding state, the lowest covering flake 440 contacts the bottom the housing 41, so the traffic light assembly 40 is closed. When the corresponding light module 42 is turned on, the foldable cover 44 may fold upward by an actuator, and the signal of the light module 42 is shown. The traffic light assembly 40 may also include a cleaning device (not shown in FIG. 5 and FIG. 6) located on an outer surface of the foldable cover 40 to clean the snow and dust on the foldable cover 44.

The traffic light assembly of the present disclosure includes the cleaning device or the foldable cover to prevent snow, sand and moisture from entering the traffic light assembly. Thus, snow and sand located in the light-emitting path are decreased, and clarity of the traffic signal is ensured.

It is to be understood, however, that even though numerous characteristics and advantages of various embodiments have been set forth in the foregoing description, together with details of the structures and functions of the embodiments, the disclosure is illustrative only; and that changes may be made in detail, especially in matters of arrangement of parts within the principles of the present disclosure to the full extent indicated by the broad general meaning of the terms in which the appended claims are expressed.

What is claimed is:

1. A traffic light assembly, comprising:
at least one light module;
at least one lens located in front of the at least one light module;
a housing enclosing the at least one light module and the at lest one lens; and
a foldable cover located in front of the at least one lens and connected to the housing;
wherein the foldable cover comprises a plurality of covering flakes slidably attached to each other.

2. The traffic light assembly of claim 1, further comprising a cleaning device located on an outer surface of the foldable cover.

3. The traffic light assembly of claim 2, wherein the foldable cover is transparent.

4. The traffic light assembly of claim 2, wherein the cleaning device comprises:
a wiper located on the outer surface of the foldable cover; and
a driver configured for driving the wiper to brush the foldable cover.

* * * * *